US007934773B2

(12) United States Patent
Boulais et al.

(10) Patent No.: US 7,934,773 B2
(45) Date of Patent: May 3, 2011

(54) MOTION-ENABLED MOVIE THEATER SEAT

(75) Inventors: Steve Boulais, St-Jean-sur-Richelieu (CA); Jean Martin Lizotte, St-Philippe (CA); Sylvain Trottier, St-Lambert (CA); Stéphane Gagnon, Laval (CA)

(73) Assignee: D-Box Technologies inc., Longueuil, QC (CA)

( * ) Notice: Subject to any disclaimer, the term of this patent is extended or adjusted under 35 U.S.C. 154(b) by 221 days.

(21) Appl. No.: 12/249,919

(22) Filed: Oct. 11, 2008

(65) Prior Publication Data

US 2010/0090507 A1 Apr. 15, 2010

(51) Int. Cl.
*A47C 1/00* (2006.01)

(52) U.S. Cl. ..... 297/325; 297/344.15; 297/217.3

(58) Field of Classification Search ..... 297/217.3, 297/313, 314, 322, 325, 329, 344.11, 344.15, 297/344.16
See application file for complete search history.

(56) References Cited

U.S. PATENT DOCUMENTS

| | | | | | |
|---|---|---|---|---|---|
| 3,577,655 | A | * | 5/1971 | Pancoe | 434/58 |
| 3,645,011 | A | | 2/1972 | Callanen | |
| 3,923,300 | A | | 12/1975 | Tanus | |
| 4,066,256 | A | | 1/1978 | Trumbull | |
| 5,009,412 | A | * | 4/1991 | Roodenburg et al. | 472/59 |
| 5,022,384 | A | | 6/1991 | Freels et al. | |
| 5,022,708 | A | | 6/1991 | Nordella et al. | |
| 5,496,220 | A | * | 3/1996 | Engstrand | 472/60 |
| 5,605,462 | A | | 2/1997 | Denne | |
| 5,678,889 | A | * | 10/1997 | Purcell, Jr. | 297/257 |
| 5,954,508 | A | | 9/1999 | Lo et al. | |
| 6,056,362 | A | * | 5/2000 | de la Haye | 297/314 |
| 6,162,058 | A | | 12/2000 | Yang | |
| 6,396,462 | B1 | | 5/2002 | Mead, Jr. et al. | |
| 6,413,090 | B1 | | 7/2002 | Shiina et al. | |
| 6,733,293 | B2 | | 5/2004 | Baker et al. | |
| 6,793,495 | B2 | | 9/2004 | Kang | |
| 7,382,830 | B2 | | 6/2008 | Kondo et al. | |
| 2005/0277092 | A1 | | 12/2005 | Hwang | |
| 2006/0046230 | A1 | | 3/2006 | MacDonald | |
| 2008/0009776 | A1 | | 1/2008 | Trandafir | |

* cited by examiner

*Primary Examiner* — Sarah B McPartlin
(74) *Attorney, Agent, or Firm* — Benoît & Côté

(57) ABSTRACT

The present document describes an actuated chair for inducing motion with respect to the ground as a function of motion signals synchronized with a video output of a feature length movie. The chair comprises a seat base, and an actuating base for receiving the motion signals. The actuating base comprises three link members, namely a first link member, a second link member and a third link member. Each link member has one translational degree of freedom and two rotational degrees of freedom. The first link member and the second link member are attached to the seat base closer to the rear edge than the third link member. The actuating base further comprises three linear actuators for inducing motion to the seat base. The actuators are fixed to the frame and each actuator is respectively connected to the seat base using a respective one of the three link members.

19 Claims, 4 Drawing Sheets

MOTION-ENABLED MOVIE THEATER SEAT

CROSS-REFERENCE TO RELATED APPLICATIONS

This application is the first disclosure of this invention.

TECHNICAL FIELD

This description relates to the field of motion-enabled chair. More particularly, this description relates to actuation of movie theatre seats.

BACKGROUND

Prior art systems include motion simulators and motion chairs used in homes, in video game arcades and in attraction park rides.

There is a need to introduce the technology of providing motion in seats installed in movie theatres. In the context of a movie theatre, restrictions relative to the space occupied by each individual seat are present and need to be overcome.

SUMMARY OF THE INVENTION

According to an aspect of the invention, there is provided an actuated chair for providing seating and inducing motion to a single user with respect to the ground as a function of motion signals synchronized with a video output of a feature length movie. The chair comprises a seat base for providing seating to the single user. The seat base has a rear edge. The chair further comprises an actuating base for receiving the motion signals. The actuating base is located substantially between the seat base and the ground and comprises a frame for interfacing with the ground. The actuating base also comprises three link members, namely a first link member, a second link member and a third link member. Each link member has one translational degree of freedom and two rotational degrees of freedom. The first link member and the second link member are attached to the seat base closer to the rear edge than the third link member. The actuating base further comprises three linear actuators for inducing motion to the seat base. The actuators are fixed to the frame and each actuator is respectively connected to the seat base using a respective one of the three link members.

According to another aspect of the invention, there is provided an actuated chair for providing seating and inducing motion to one or more users with respect to the ground as a function of motion signals. The chair comprises a seat base for providing seating to the one or more users. The seat base has a rear edge. The chair further comprises an actuating base for receiving the motion signals. The actuating base comprises a frame for interfacing with the ground. The actuating base also comprises a link member having a translational degree of freedom and a rotational degree of freedom. The actuating base further comprises a linear actuator for inducing motion to the seat base. The actuator is fixed to the frame and is connected to the seat base using the link member.

According to yet another aspect of the invention, there is provided an actuating base for installation to a seat base between the seat base and the ground. The seat base is for providing seating to a user. The seat base has a rear edge. The actuating base is for inducing motion to the user with respect to the ground as a function of motion signals. The actuating base comprises a frame for interfacing with the ground. The actuating base also comprises a link member having a translational degree of freedom and a rotational degree of freedom.

The actuating base further comprises a linear actuator for inducing motion to the seat base. The actuator is fixed to the frame and being connected to the seat base using the link member.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
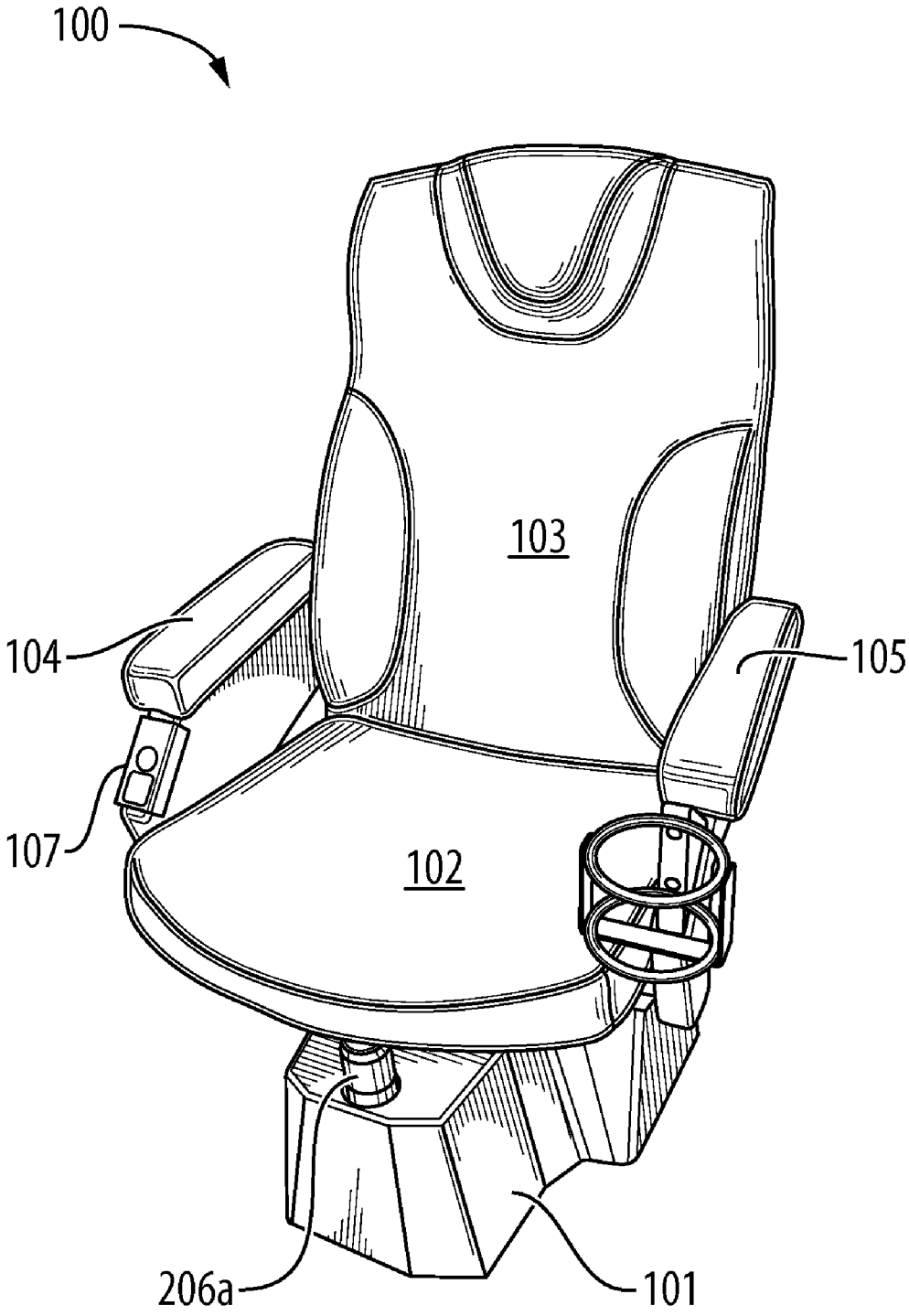
FIG. 1 is a perspective view of a chair according to an embodiment of the invention.
Figure 2:
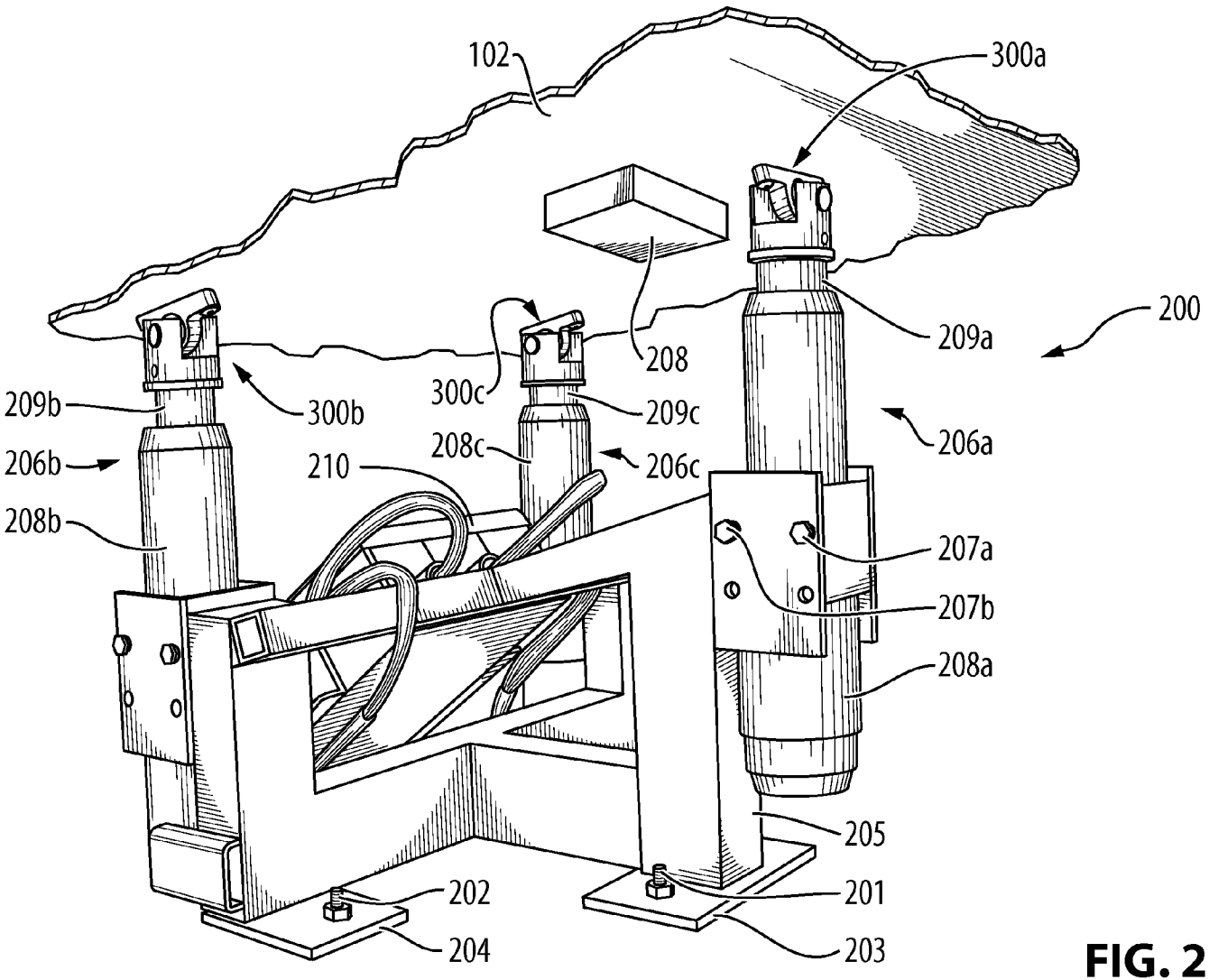
FIG. 2 is a perspective view of an actuated base according to an embodiment of the invention.

Referring to the drawings, and more particularly to FIGS. 1 and 2, an actuated movie chair 100 (FIG. 1) is shown. The base 200 (FIG. 2) of the chair 100 lies on the ground and is covered by a protective cover 101. The seating portion of the chair 100 is very similar to a standard movie chair or seat and comprises a seat base 102, a backrest 103 and armrests 104-105. Although the chair 100 shown in FIG. 1 is designed for one user/movie viewer, it is understood that the concepts described herein extend to multi-user chair as well.

Between the protective cover 101 and the seat base 102 there may be a protection skirt (not shown) for preventing users from injury while viewing a moving which comprising motion effects. According to an embodiment, the terms "protective cover" includes the protection skirt. The protection skirt is horizontally wrinkled and made of flexible material to adjust itself during the actuating (movement of the chair).

Below the right armrest 104, a control panel 107 is accessible to the user for controlling the intensity (e.g., the amplitude range of the actuators 206*a-b-c*) of the motion effect inducing in the chair 100. Some of the options (i.e., modes of operation) include "Off" (i.e., no motion), "Light" (i.e., reduced motion), "Normal" (i.e., regular motion), "Heavy" (i.e., maximum motion), "Discreet" (i.e., fully controllable motion level between "Off" and "Heavy"), and "Automatic". Optionally, a vibration signal, a sound signal or light signal is provided to the user to indicate in which mode of operation or at which intensity level the chair 100 is operating.

In the "Automatic" mode, the chair 100 uses a sensor (not shown) to detect a characteristic of the user (e.g., weight) and, based on the characteristic, determines the setting for the level of motion that will be induced in the chair 100. The sensor function can be achieved by a combination of feedback through one or more actuators 206*a-b-c* and software algorithm hosted in the processor (not shown) of the controller 210. The weight sensor function can also be achieved by using a separate sensor 208 (see FIG. 2) installed on the chair 100. Sensor 208 is in communication (wired or wireless) communication with the controller 210 to determine, using a software algorithm, a characteristic of the user. The control panel 107 is therefore in communication with the controller 210.

Referring to FIG. 2, there is shown an actuating base 200 anchored to the floor using bolts 201-202 via anchor points (not visible) through anchor plates 203-204 (and another anchor plate which is not visible). Anchor plates 203-204 are fixed (e.g., welded) to a frame 205. The fixed portions 208*a-b-c* of the three electrical linear actuators 206*a-b-c* are fixed to the frame 205 using bolts 207*a-b*. Actuators 206*a-b-c* may be thereby be removed and replaced. During use of the chair 100, there is no relative movement between the fixed portions 208*a-b-c* of the three electrical linear actuators 206*a-b-c* and the frame.

The linear directions of movement of each of the actuators 206*a-b-c* define three linear axes which are substantially vertical (i.e., perpendicular) with respect to the ground or floor on which the chair is installed.

The mobile portions 209*a-b-c* of the actuators 206*a-b-c* are connected to the seat base 102 using link members 300*a-b-c*. In the embodiment shown in FIG. 2, the fixed portion 208*a* of the front actuators 206*a* is more distant from the ground than the fixed portions 208*b-c* of the two rear actuators 206*b-c*. This results in a rearward inclination of the seat base 102 when the actuators 206*a-b-c* are in their reference position. The inclination of the seat base 102 is useful in providing a natural seating position to the user.

The person skilled in the art will understand that electrical linear actuators 206*a-b-c* can be replaced by any linear actuators powered by any other types of energies such as hydraulic, pneumatic, or thermal.

The function of controller 210 is to receive motion signals from an encoder (not shown) and interpret and transform the motion signals into drive signals for driving each actuator 206*a-b-c*.

The controller 210, or another electronic device with a processor and memory (not shown), may include functionalities related to the maintenance of the actuators 206*a-b-c*. This includes saving data in memory for download and analysis. The types of data include: time since installation, time since new, time under power, accelerations induced to the chair over time, number of movie representations shown, etc.

Figure 3:
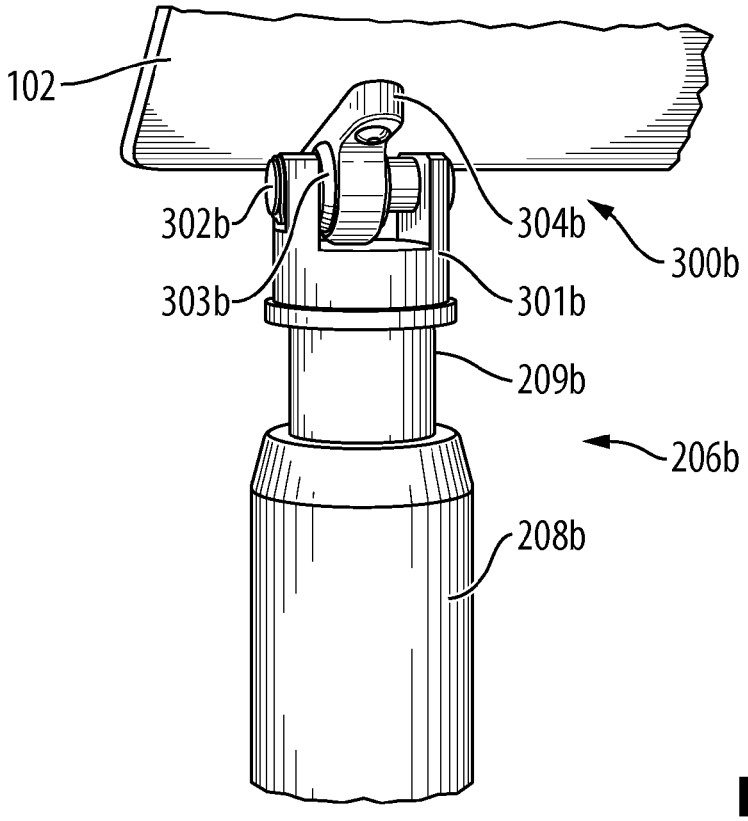
FIG. 3 is a perspective view of a rear link member according to an embodiment of the invention.
Figure 5:
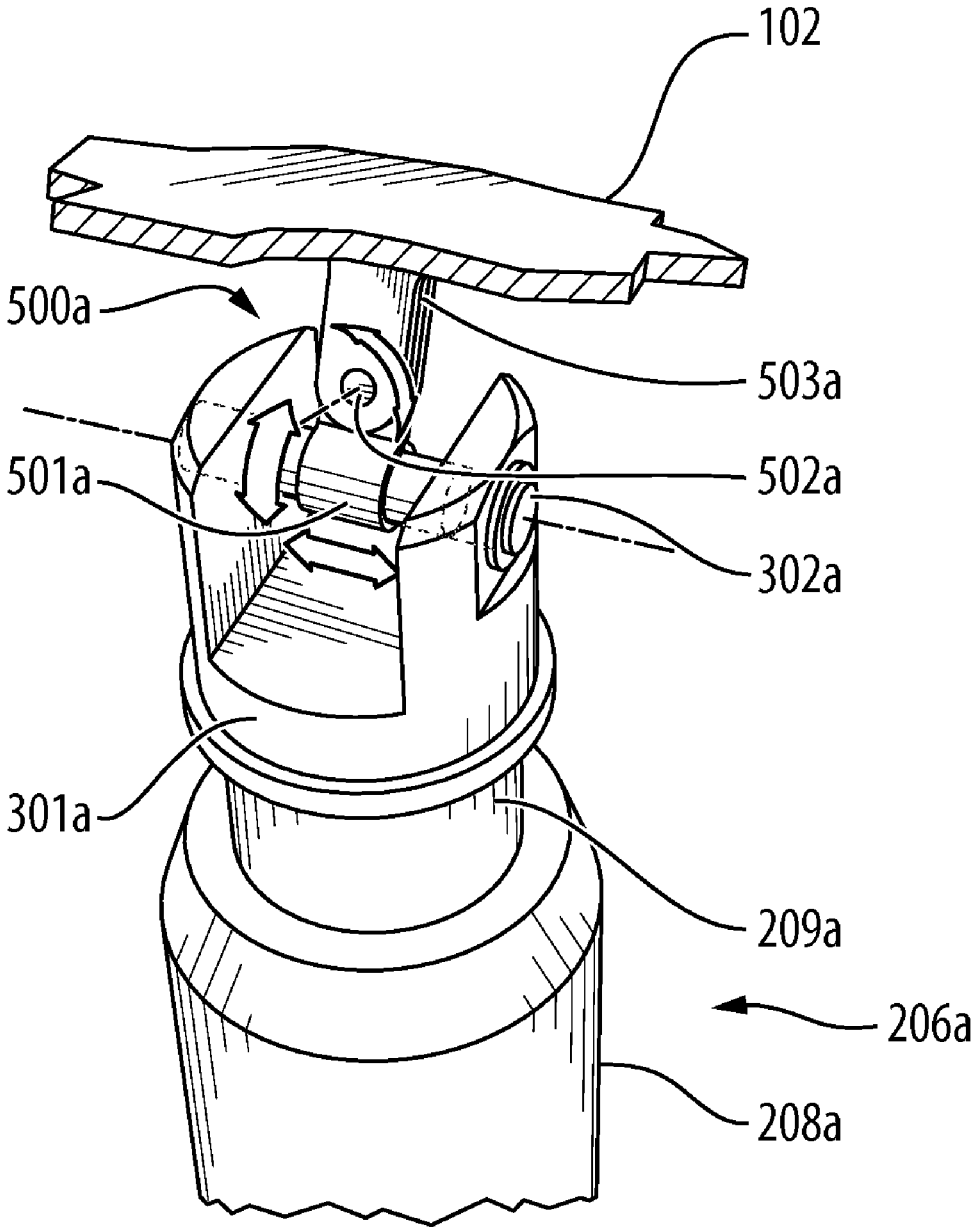
FIG. 5 is a perspective view of a front link member according to another embodiment of the invention.

Now referring to FIG. 3, there is shown the link member 300*b* between the actuator 206*b* and the seat base 102 located at the right rear corner of the seat base 102. The link member 300*b* comprises an eye connector 304*b* mounted on a ball 303*b* having a hole for admitting a shaft 302*b* therethrough. The eye connector 304*b* is screwed into the seat base 102. The ball 303*b* provides three rotational degrees of freedom. A person skilled in the art will understand that only two of the three rotational degrees of freedom could be used. An embodiment where only two rotational degrees of freedom are present is shown in FIG. 5.

The shaft 302*b* is mounted on a cradle 301*b* attached to the mobile portion 209*b* of the actuator 206*b*. The ball 303*b* is free to move on the shaft 302*b*. The movement of the ball 303*b* on the shaft 302*b* provides a translational degree of freedom along a longitudinal axis of the shaft 302*b*.

The longitudinal axis of the shaft 302*b* is from right to left of the seat base 102 from the point of view of the user.

Figure 4:
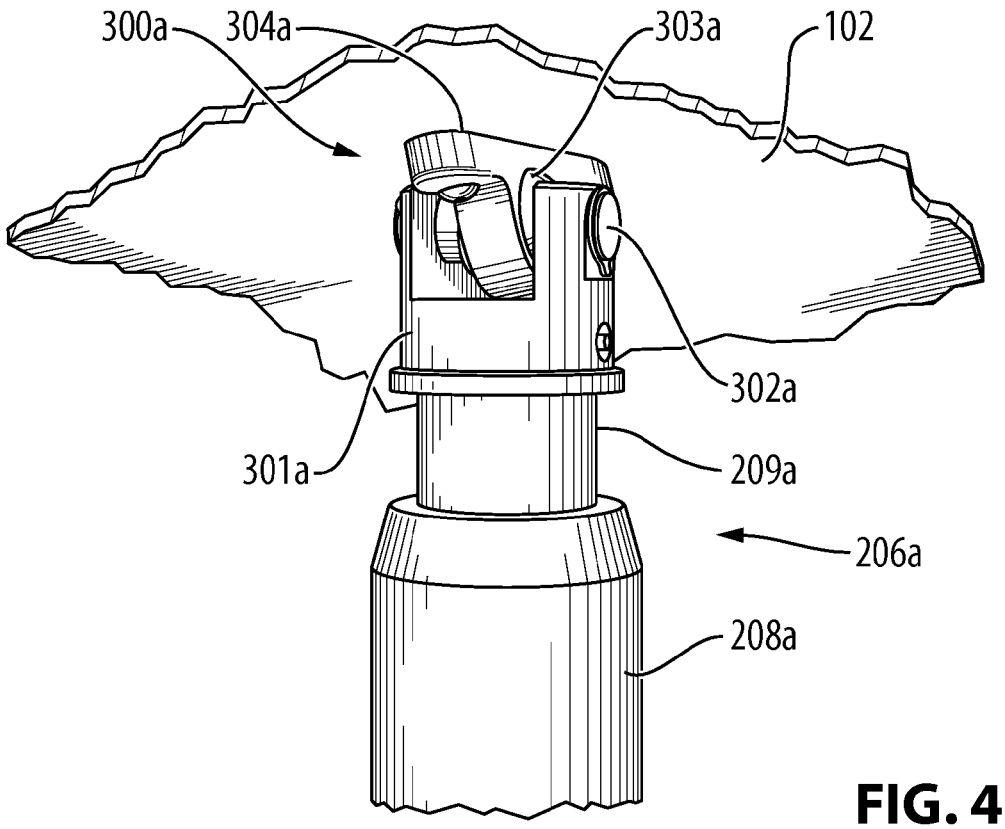
FIG. 4 is a perspective view of a front link member according to an embodiment of the invention.

Referring to FIG. 4, there is shown the link member 300*a* between the actuator 206*a* and the seat base 102 centered at the front of the seat base 102. The link member 300*a* comprises an eye connector 304*a* mounted on a ball 303*a* having a hole for admitting a shaft 302*a* therethrough. The eye connector 304*a* is screwed into the seat base 102. The ball 303*a* provides three rotational degrees of freedom.

The shaft 302*a* is mounted on a cradle 301*a* attached to the mobile portion 209*a* of the actuator 206*a*. The ball 303*a* is free to move on the shaft 302*a*. The movement of the ball 303*a* on the shaft 302*a* provides a translational degree of freedom along a longitudinal axis of the shaft 302*a*.

The longitudinal axis of the shaft 302*a* is from front to rear of the seat base from the point of view of the user. The actuator 206*a* is located in the middle of the front edge of the seat base 102 thereby providing free space on each side thereof for the legs of the user under the seat base 102.

The embodiment described is useful for inducing motion to a user in two rotational degrees of freedom to pitch and roll and in one translational up/down degree of freedom.

Other embodiments are possible where only two actuators are used at the back of the seat base 102 and one fixed point of contact is present forward of the two actuators. Other possible embodiments would include only one actuator, possibly at the front of the seat base 102, and one or more fixed point of contact, possibly at the back of the seat base 102.

Now referring to FIG. 5, there is shown another embodiment of a link member 500*a*. In FIG. 5, link member 500*a* is installed between the actuator 206*a* and the seat base 102. Other link members which may be installed at the rear of seat base 102 are not shown.

In an embodiment, link member 500*a* would be attached at the center forward of the middle of the seat base 102. The link member 500*a* comprises a connector 503*a* mounted on a pivot joint 502*a* forming part of a sliding ring 501*a* for admitting a shaft 302*a* therethrough. The connector 503*a* is screwed into the seat base 102. The link member 500*a* provides two rotational degrees of freedom as shown by the curved arrows.

The shaft 302*a* is mounted on a cradle 301*a* attached to the mobile portion 209*a* of the actuator 206*a*. The sliding ring 501*a* is free to move on the shaft 302*a*. The movement of the sliding ring 501*a* on the shaft 302*a* provides a translational degree of freedom along a longitudinal axis of the shaft 302*a*.

While preferred embodiments of the invention have been described above and illustrated in the accompanying drawings, it will be evident to those skilled in the art that modifications may be made therein without departing from the essence of this invention. Such modifications are considered as possible variants comprised in the scope of the invention.

The invention claimed is:

1. An actuated chair for providing seating and inducing motion to a single user with respect to the ground as a function of motion signals synchronized with a video output of a feature length movie, the chair comprising:

a seat base for providing seating to the single user, the seat base having a rear edge; and an actuating base for receiving the motion signals, the actuating base located substantially between the seat base and the ground and comprising:

a frame for interfacing with the ground;

three link members, namely a first link member, a second link member and a third link member, each link member having one translational degree of freedom and two rotational degrees of freedom, the first link member and the second link member being attached to the seat base closer to the rear edge than the third link member; and three linear actuators for inducing motion to the seat base, the actuators being fixed to the frame and each actuator respectively connected to the seat base using a respective one of the three link members.

2. The chair as in claim 1, wherein each translational degree of freedom of the link members has an axis, namely a first axis, a second axis and a third axis, the first axis and the second axis are parallel to each other, and the third axis is perpendicular to the first axis and the second axis.

3. The chair as in claim 1, further comprising a control panel for controlling the intensity of the motion induced to the seat base.

4. The chair as in claim 3, further comprising a sensor for sensing a user characteristic for use in controlling the intensity of the motion induced to the seat base.

5. The chair as in claim 1, wherein each linear actuator is for moving in a linear direction thereby defining three linear axes, at least two of the linear axes being substantially parallel to each other and substantially perpendicular to the ground.

6. The chair as in claim 1, wherein each link member comprises an eye connector connected to the seat base and having a ball on which the eye connector rotates, the ball having a hole for admitting a shaft therethrough, each one of the link members connecting a respective one of the at least three linear actuators to the seat base, the ball providing the two rotational degrees of freedom and a third rotational degree of freedom.

7. The chair as in claim 6, wherein each link member further comprises a cradle and the shaft, the shaft being mounted on the cradle, wherein movement of the ball on the shaft provides the translational degree of freedom.

8. The chair as in claim 1, wherein a volume is defined by a projection of the seat base to the ground and wherein the actuating base is entirely contained within the volume.

9. The chair as in claim 8, further comprising a protective cover attached to the actuating base between the ground and the seat for protecting the volume under the seat thereby preventing injury to the single user.

10. The chair as in claim 1, wherein the frame comprises an anchor point for anchoring the actuating base to the ground.

11. An actuated chair for providing seating and inducing motion to one or more users with respect to the ground as a function of motion signals, the chair comprising:

a seat base for providing seating to the one or more users; and an actuating base for receiving the motion signals, the actuating base comprising:

a frame for interfacing with the ground;

a link member having a translational degree of freedom and two rotational degrees of freedom; and a linear actuator for inducing motion to the seat base, the actuator being fixed to the frame and being connected to the seat base using the link member, wherein:

the linear actuator comprises at least two linear actuators for inducing motion to the seat base, the actuators being fixed to the frame and each actuator respectively connected to the seat base using a respective link member, namely a first link member and a second link member, each link member having at least one translational degree of freedom and at least two rotational degrees of freedom; and each linear actuator is for moving in a linear direction thereby defining two linear axes, the two linear axes being substantially parallel to each other and substantially perpendicular to the ground.

12. The chair as in claim 11, further comprising a control panel for controlling the intensity of the motion induced to the seat base.

13. The chair as in claim 12, further comprising a sensor for sensing a user characteristic for use in controlling the intensity of the motion induced to the seat base.

14. The chair as in claim 11, where the link member comprises a sliding ring for admitting a shaft therethrough and sliding thereon, the sliding ring comprising a pivot joint, the link member further comprises a connector connected to the seat base and pivotally connected to the pivot joint.

15. The chair as in claim 11, wherein a volume is defined by a projection of the seat base to the ground and wherein the actuating base is entirely contained within the volume.

16. An actuated chair for providing seating and inducing motion to one or more users with respect to the ground as a function of motion signals, the chair comprising:

a seat base for providing seating to the one or more users; and an actuating base for receiving the motion signals, the actuating base comprising:

a frame for interfacing with the ground;

a link member having a translational degree of freedom and two rotational degrees of freedom; and a linear actuator for inducing motion to the seat base, the actuator being fixed to the frame and being connected to the seat base using the link member;

wherein the link member comprises an eye connector connected to the seat base and having a ball on which the eye connector rotates, the ball having a hole for admitting a shaft therethrough, the link member connecting the linear actuator to the seat base, the ball providing the rotational degree of freedom.

17. The chair as in claim 16, wherein each link member further comprises a cradle and the shaft, the shaft being mounted on the cradle, wherein movement of the ball on the shaft provides the translational degree of freedom.

18. An actuating base for installation to a seat base between the seat base and the ground, the seat base for providing seating to a user, the actuating base for inducing motion to the user with respect to the ground as a function of motion signals, the actuating base comprising:

a frame for interfacing with the ground;

a link member having a translational degree of freedom and a rotational degree of freedom; and a linear actuator for inducing motion to the seat base, the actuator being fixed to the frame and being connected to the seat base using the link member, wherein:

the linear actuator comprises at least two linear actuators for inducing motion to the seat base, the actuators being fixed to the frame and each actuator respectively connected to the seat base using a respective link member, namely a first link member and a second link member, each link member having at least one translational degree of freedom and at least two rotational degrees of freedom; and each linear actuator is for moving in a linear direction thereby defining two linear axes, the two linear axes being substantially parallel to each other and substantially perpendicular to the ground.

19. An actuated chair for providing seating and inducing motion to one or more users with respect to the ground as a function of motion signals, the chair comprising:

a seat base for providing seating to the one or more users; and an actuating base for receiving the motion signals, the actuating base comprising:

a frame for interfacing with the ground;

a link member having a translational degree of freedom and two rotational degrees of freedom; and a linear actuator for inducing motion to the seat base, the actuator being fixed to the frame and being connected to the seat base using the link member;

said linear actuator is for moving in a linear direction thereby defining a linear axe which is fixed and substantially perpendicular to the ground.

* * * * *